US012228021B2

(12) United States Patent
Copeland

(10) Patent No.: US 12,228,021 B2
(45) Date of Patent: Feb. 18, 2025

(54) BOTTOM TUBING CAP FOR DOWNHOLE PUMP SYSTEMS

(71) Applicant: Carter D. Copeland, Houston, TX (US)

(72) Inventor: Carter D. Copeland, Houston, TX (US)

( * ) Notice: Subject to any disclaimer, the term of this patent is extended or adjusted under 35 U.S.C. 154(b) by 60 days.

(21) Appl. No.: 18/201,807

(22) Filed: May 25, 2023

(65) Prior Publication Data

US 2024/0392664 A1 Nov. 28, 2024

(51) Int. Cl.
*E21B 43/12* (2006.01)

(52) U.S. Cl.
CPC ..... *E21B 43/127* (2013.01)

(58) Field of Classification Search
CPC ..... E21B 43/127; E21B 43/12; E21B 43/126
See application file for complete search history.

(56) References Cited

U.S. PATENT DOCUMENTS 2,829,099 A 4/1958 Marsh
3,029,195 A 4/1962 Marsh
3,674,662 A 7/1972 Haycock
4,211,625 A 7/1980 Vandevier et al.
5,664,628 A * 9/1997 Koehler ..... B01D 29/58 166/228
8,887,832 B2 11/2014 Trinh et al.
9,617,838 B2 * 4/2017 Purcell ..... F04B 47/00
9,816,338 B1 * 11/2017 Hanson ..... E21B 43/084
2010/0252271 A1 * 10/2010 Kelley ..... E21B 43/14 166/370
2013/0037255 A1 * 2/2013 Kash ..... E21B 43/116 166/55
2015/0299863 A1 10/2015 Champagne et al.
2016/0032693 A1 * 2/2016 Lehrling ..... E21B 17/1078 166/185
2016/0333681 A1 * 11/2016 Mazzanti ..... E21B 43/35
2018/0363432 A1 * 12/2018 Purcell ..... F04B 47/00
2019/0003278 A1 * 1/2019 Varkey ..... E21B 33/08
2019/0330947 A1 * 10/2019 Mulhern ..... E21B 23/0414
2022/0282597 A1 * 9/2022 Hamid ..... E21B 49/087
2022/0333464 A1 10/2022 Perri et al.

OTHER PUBLICATIONS

MIL-DTL-24779; Anodes, Sacrificial, Aluminum Alloy; US Military Specification; US Department of the Navy; 47 pages; Published Jul. 23, 2009.

* cited by examiner

*Primary Examiner* — David Carroll
(74) *Attorney, Agent, or Firm* — bobharter.com; Rogert J. Harter

(57) ABSTRACT

A bottom tubing cap attached to a string of tubing, below the downhole pump of an oil well, includes a protective plug made of an alloy of aluminum or comparable material. The alloy is melted and cast into an internally threaded collar. In some examples, the collar screws onto a combination bull plug, which in turn is coupled to a perforated section of tubing. In some examples, a polymeric coating covers an interface where the protective plug meets the collar.

18 Claims, 9 Drawing Sheets

BOTTOM TUBING CAP FOR DOWNHOLE PUMP SYSTEMS

FIELD OF THE DISCLOSURE

This patent generally pertains to oil wells with downhole pumps and more specifically to means for prolonging the life of casings, tubing and/or collars associated with such oil wells.

BACKGROUND

An oil well is a complex engineering system designed for extracting crude oil or other production fluid from the earth's crust. The system consists of various parts including a wellhead, casing, production tubing, a pumpjack, sucker rods, a downhole pump, a seating nipple, a gas anchor, and a bull plug. The wellhead is located at the surface and serves as the entry point to the wellbore.

The casing is a long series of steel pipe that lines the hole drilled in the ground and protects the wellbore from collapsing. It also helps inhibit oil, gas, and water from mixing and contaminating the oil reservoir deep underground.

The production tubing, on the other hand, is smaller in diameter than the casing. Tubing is made up of several individual pipes, called joints, that are threaded together to form a continuous string. The string of tubing runs from the wellhead and down through the casing to where it connects to the downhole pump. Tubing is designed to transport the oil from the reservoir to the surface.

Sucker rods are a series of long steel rods that are threaded together to form a continuous string of sucker rods. The sucker rods extend from the pumpjack at the surface, down through the production tubing, and to the downhole pump. The sucker rods transmit the up-and-down motion of the pumpjack to the downhole pump.

The downhole pump is a mechanical reciprocating pump attached to the production tubing near the bottom of the wellbore to extract oil from the reservoir. The downhole pump is driven in reciprocating motion by the pumpjack, via the sucker rods, to force the oil up through the tubing to the surface.

Other parts of an oil well include the bull plug, seating nipple, and gas anchor. The bull plug is a solid metal plug used to close the lower end of the tubing. The seating nipple affixes the downhole pump to the string of tubing. The gas anchor is a perforated tube extending below the downhole pump. The gas anchor helps separate gas from the oil, thereby ensuring that the oil flows smoothly up the tubing.

Over time, some parts of an oil well can erode or corrode, leading to reduced efficiency and potentially dangerous conditions. The casing and tubing, for example, can experience corrosion-induced pitting due to exposure to acidic gases or fluids, leading to leaks and instability.

DETAILED DESCRIPTION

FIGS. 1-12 illustrate example bottom tubing caps 10 and related methods that can help prolong the life of certain parts of a well 12. The well 12 can be used for drawing a production fluid 14 up from an underground source to the Earth's surface. Some examples of the production fluid 14 include oil, gas, water, and mixtures thereof, etc.

Figure 1:
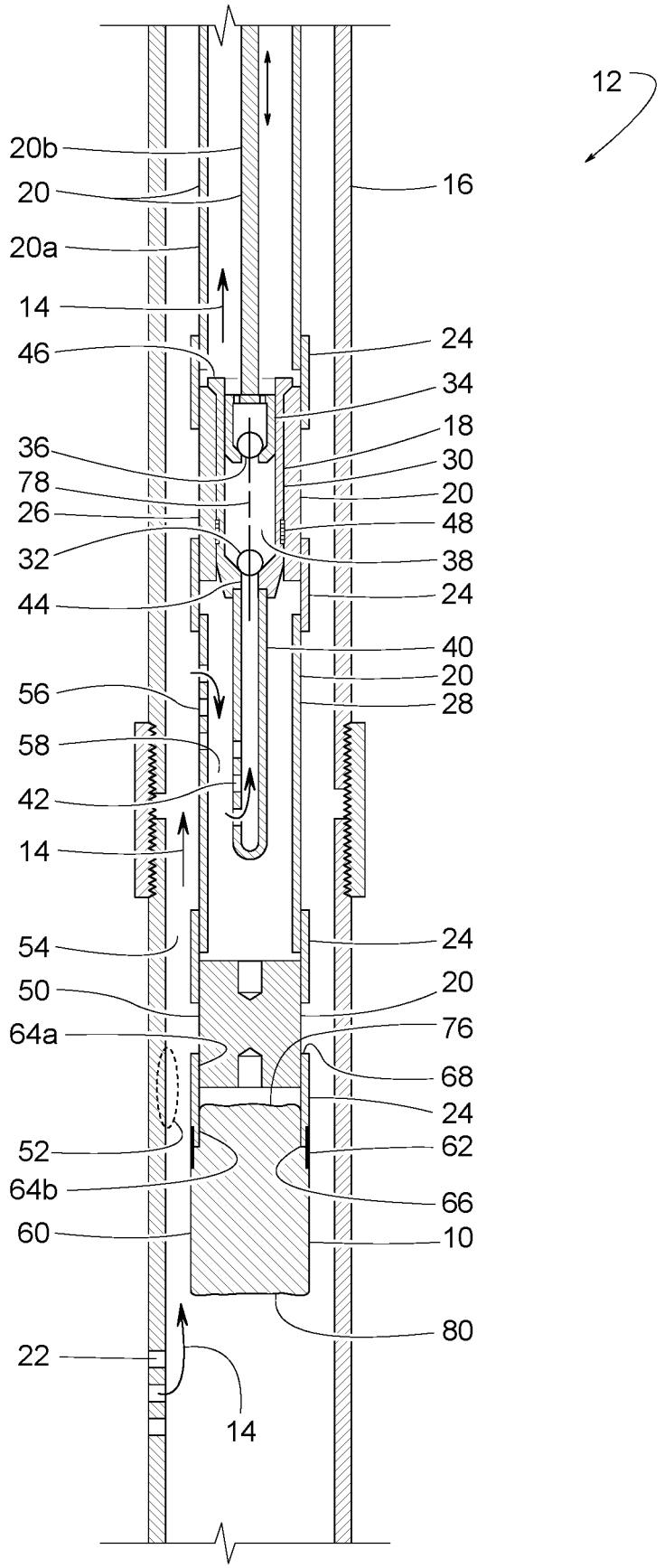
FIG. 1 is a cross-sectional side view of an oil well constructed in accordance with the teachings disclosed herein.

Referring to FIG. 1, some main components of the well 12 include a casing 16, a downhole pump 18, and a wellstring 20 (e.g., a string of tubing 20*a* and a string of sucker rods 20*b*). The casing 16 provides the well 12 with a rigid outer wall. The casing 16 has perorations 22 for allowing the production fluid 14 from the underground source to enter the well 12. The pump 18 forces the production fluid 14 to the surface.

In some examples, the string of sucker rods 20*b* is interconnected by threaded connections. Likewise, some examples of the string of tubing 20*a* are interconnected by threaded tubing collars 24 (also known as couplings). In the illustrated example, the string of tubing 20*a* includes a seating nipple 26 and a perforated sub 28. The seating nipple 26 holds the pump 18, and the perforated sub 28 is a section of perorated tube extending several feet below the pump 18.

Some examples of the downhole pump 18 include a pump housing 30 with a standing valve 32, a plunger 34 with a traveling valve 36, and a pump chamber 38 between the two valves 32 and 36. In some examples, a gas anchor 40, in the form of a tube with slits 42, connects to the lower end of the pump housing 30. The gas anchor 40 directs the production fluid 14 into a suction inlet 44 that leads to the standing valve 32. An upper flange 46 and a set of seals 48 (e.g., packing, glands, chevron seals, etc.) holds the pump housing 30 fixed to the seating nipple 26.

In the illustrated example, a combination bull plug 50 is screwed onto a lower tubing collar 24 to block off the bottom end of the perforated sub 28. The combination bull plug 20 helps prevent the production fluid 14 from bypassing a gas/liquid separation flow pattern created by gas anchor 40 and the perforated sub 28. Details of the combination bull plug 20 can be found in U.S. Pat. D818,804; which is specifically incorporated herein by reference.

To mitigate chemical or galvanic corrosion of the casing 16, the tubing collars 24, and/or the perforated sub 28; the bottom tubing cap 10 is attached to the lower end of the wellstring 20, as shown in FIG. 1. Galvanic corrosion on the casing 16 in a localized area 52 near the bottom of the wellstring 20 can be particularly detrimental, as repairing corrosion in the localized area 52 can be difficult or nearly impossible and very expensive.

Under normal operation, the production fluid 14 flows sequentially through the perforations 22 in the casing 16. up through an annulus 54 between the casing 16 and the string of tubing 20*a*, through apertures 56 in the perforated sub 28, down through another annulus 58 between the perforated sub 28 and the gas anchor 40, through the slits 42 in the gas anchor 40, up through the gas anchor 40, through the suction inlet 44 of the pump housing 30, through the standing valve 32, through the pump chamber 38, through the traveling valve 36, and up through the string of tubing 20*a* to the top of the well 12.

The flow is driven by a known pumpjack driving the string of sucker rods 20*b* in reciprocating motion, which in turn drives the pump's plunger 34 in reciprocating motion along the pump chamber 38. The valves 32 and 36 act as one-way check valves to ensure the production fluid 14 moves in the right direction.

Figure 2:
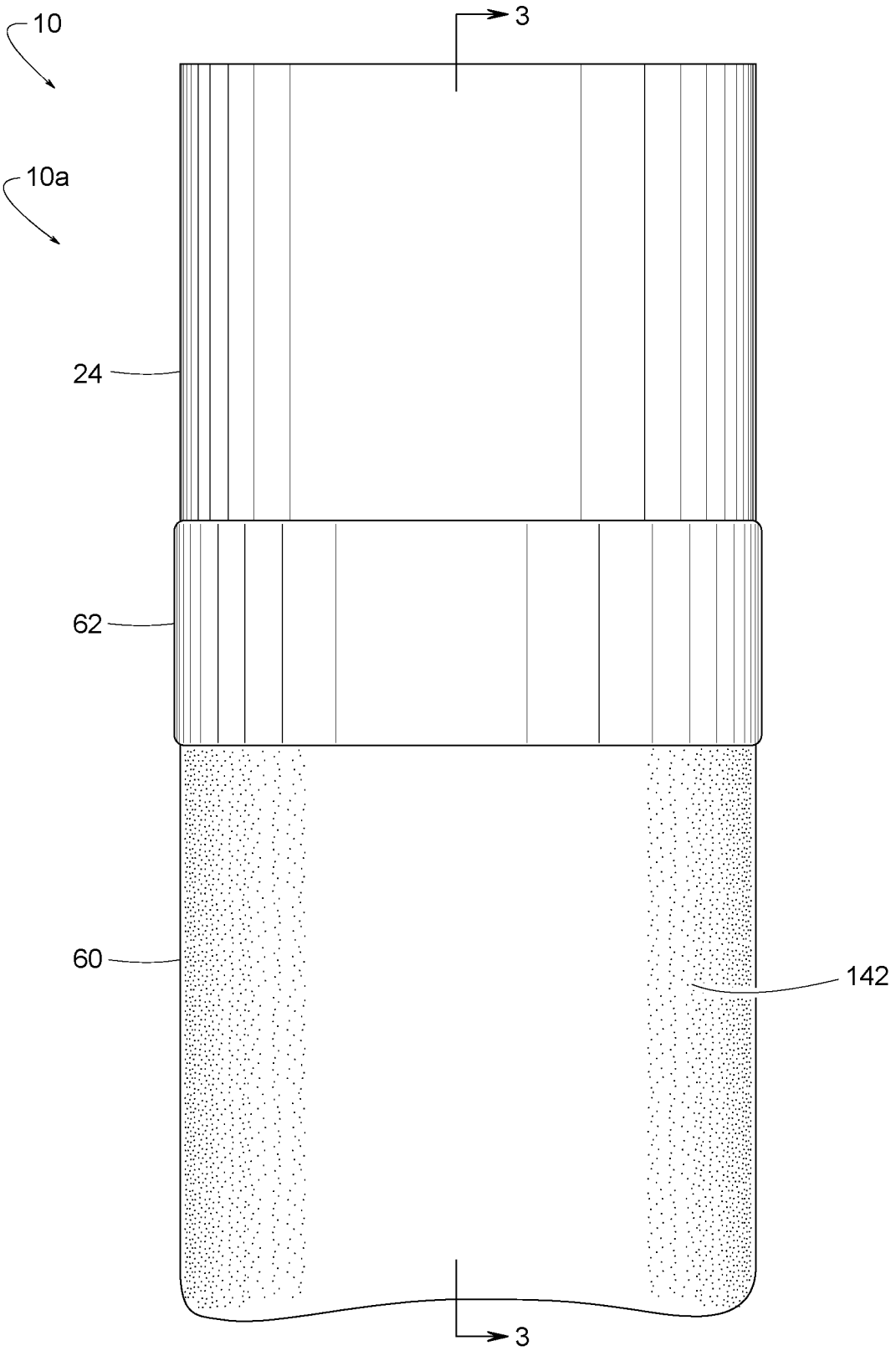
FIG. 2 is a side view of an example bottom tubing cap constructed in accordance with the teachings disclosed herein.
Figure 3:
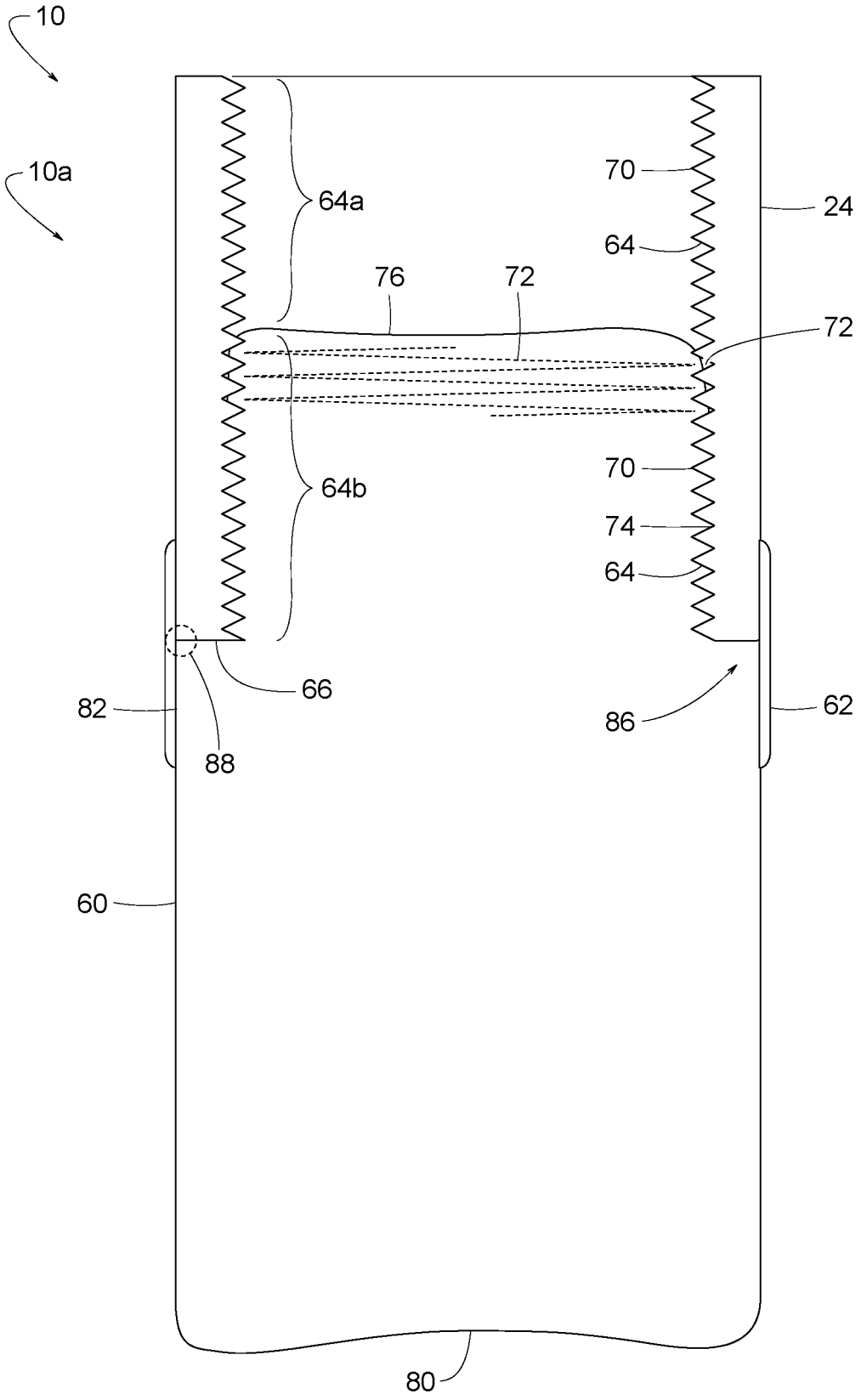
FIG. 3 is a cross-sectional view taken along line 3-3 of FIG. 2.

Various examples of the bottom tubing cap 10 (e.g., bottom tubing caps 10*a*, 10*b* and 10*c*) are shown in FIGS. 2-7. FIGS. 2 and 3 show the bottom tubing cap 10*a* comprising a collar 24, a protective plug 60, and a coating 62. In some examples, the collar 24 is made of a first material (e.g., steel) with an inner surface 64 that includes an upper section 64*a* and a lower section 64*b*. The collar 24 has a lower collar edge 66 adjacent to the lower section 64*b* and an upper collar edge 68 adjacent to the upper section 64*a*. In some examples, the upper section 64*a* has internal threads 70 for screwing the collar 24 onto the combination bull plug 20 or some other part of the wellstring 20.

In some examples, the internal threads 70 are also on the lower section 64*b* of the collar 24 to help grip the protective plug 60. In some examples, the protective plug 60 is engaged in intimate contact with the internal threads 70 on the lower section 64*b*. The term, "intimate contact," as it relates to the protective plug 60 being in intimate contact with the internal threads 70, means that at least a portion of the protective plug 60 actually touches at least a portion of the internal threads 70. So even though some portions of protective plug 60 are in intimate contact with the internal threads 70, other portions of the protective plug 60 might be spaced apart from the internal threads 70.

For instance, in some examples, even though the protective plug 60 is engaged in intimate contact with the internal threads 70 on the lower section 64*b*, the protective plug 60 and the internal threads 70 on the lower section 64*b* define a helical gap 72 therebetween. The helical gap 72 runs partway along a root 74 of the internal threads 70. So as not to diminish the structural integrity of the bottom tubing cap 10, the helical gap 72, in some examples, is spaced apart from the lower collar edge 66. Thus, in such examples, the helical gap 72 is closer to an upper plug end 76 of the protective plug 10 than to the lower collar edge 66.

In some examples, the helical gap 72 extending only partway along the thread's root 74 provides a telltale indicator that the protective plug 10 was melted and cast in place rather than machined and screwed in place. Thus, the existence of the helical gap 72 indicates that the protective plug 60 is bonded intimately well to the collar 24 to ensure an effective galvanic coupling between the protective plug 60 and the collar 24.

In some examples, the protective plug 60 is engaged in intimate contact with the collar's lower section 64*b* even in cases where the collar's lower section 64*b* does not necessarily have the internal threads 70. The protective plug 60 has its upper plug end 76 axial interposed between the lower collar edge 66 and the upper collar edge 68. The terms, "axial" and "axially" refer to a direction running parallel to a longitudinal axis 78 of the downhole pump 18.

The protective plug 60 has a lower plug end 80 extending axially beyond the collar 24. The protective plug 10 has an intermediate surface 82 axially interposed between the lower plug end 80 and the upper plug end 76. The intermediate surface 82 of the protective plug 10 is adjacent to the lower collar edge 66.

The protective plug 60 is comprised of a second material 84 (FIGS. 8 and 9) that is different than the first material of the collar 24. In some examples, the second material 84 is a metal alloy selected from the group consisting of an aluminum alloy, a magnesium alloy, and a zinc alloy. Such materials serve as a sacrificial anode for cathodic protection of the casing 16, the tubing collars 24, and/or the perforated sub 28. In selecting a material for the protective plug 60, some factors to consider include the fact that magnesium is more active (more noble) than zinc and aluminum, zinc is moderately active but can be difficult to cast, aluminum is less active than magnesium and zinc, but aluminum is easy to cast and has a relatively long lifespan. To provide cathodic protection over a sufficiently long time span, some examples of the protective plug 60 are axially longer and heavier than the collar 24.

In some examples, to help prevent galvanic corrosion at a critical location 86 where the protective plug 60 contacts the collar 24, some examples of bottom tubing cap 10 include the polymeric coating 62 that overlies the lower collar edge 66 and the intermediate surface 82 of the protective plug 60. In some examples, the polymeric coating 62 is an epoxy.

The combination of the coating 62, the collar 24 and the protective plug 60 creates a three-way interface 88 comprising three adjoining materials including a first material (steel), a second material (aluminum and alloys thereof) and a third material (polymeric material). In some examples, each of the three adjoining materials are within two millimeters of each other to inhibit corrosion in a particularly concentrated area where the three materials come together.

Although some examples of the protective plug 60 are made of pure aluminum, oxides tend to build up on pure aluminum, and oxides can inhibit cathodic protection. To minimize oxidation, some examples of protective plug 60 are comprised of an aluminum alloy, wherein only most of the alloy consists of aluminum by weight. Some example aluminum alloys have a portion of indium, wherein the indium makes up 0.014 to 0.200 percent by weight of the aluminum alloy. Some example aluminum alloys have a portion of gallium, wherein the gallium makes up 0.092 to 0.110 percent by weight of the aluminum alloy. Such proportions have been found to be effective and fall within a US military specification known as MIL-DTL-24779.

Figure 4:
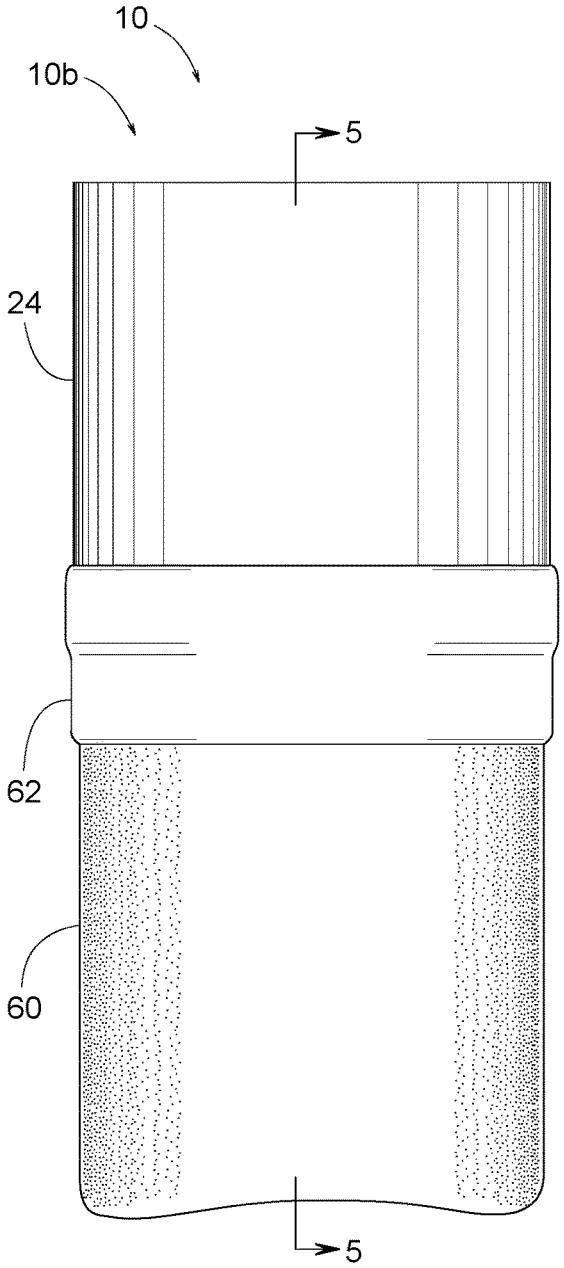
FIG. 4 is a side view of another example bottom tubing cap constructed in accordance with the teachings disclosed herein.
Figure 5:
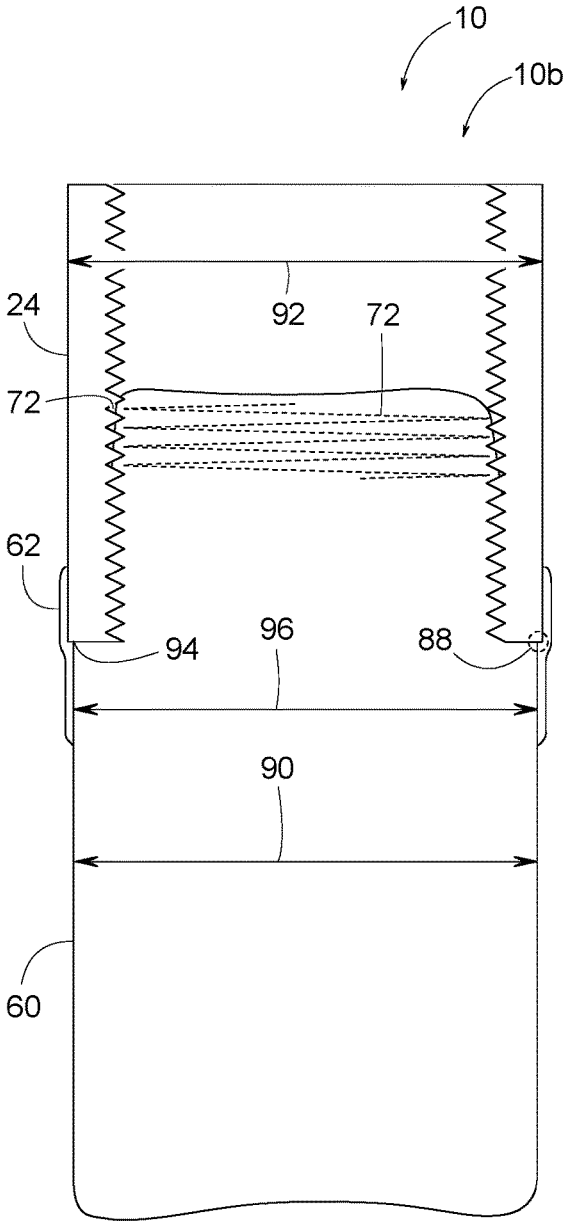
FIG. 5 is a cross-sectional view taken along line 5-5 of FIG. 4.

FIGS. 4 and 5 show the example bottom tubing cap 10*b*, which is similar to the bottom tubing cap 10*a* shown in FIGS. 2 and 3; however, an outer diameter 90 of the protective plug 60 of the bottom tubing cap 10*b* is slightly less than an outer diameter 92 of the collar 24. The slight difference in diameters 90 and 92 creates a recessed corner 94 at the three-way interface 88. When the wellstring 20 is being lowered into the casing 16, the recessed corner 94 helps prevent the coating 62 at the three-way interface 88 from getting completely scraped off by the inner wall of the casing 16. In some examples, the protective plug's outer diameter 90 is 0.5 mm to 7 mm smaller than the collar's outer diameter 92. In this example, the coating 62 has an inner diameter 96 that is the same as the protective plug's outer diameter 90, so the coating's inner diameter 96 is also less than the collar's outer diameter 92.

Figure 6:
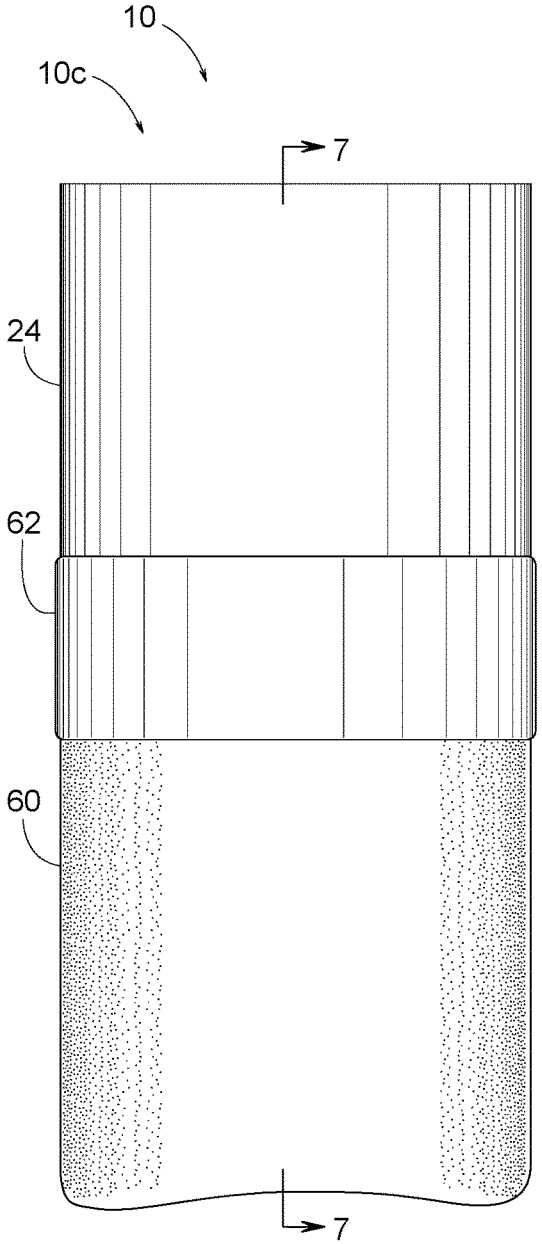
FIG. 6 is a side view of another example bottom tubing cap constructed in accordance with the teachings disclosed herein.
Figure 7:
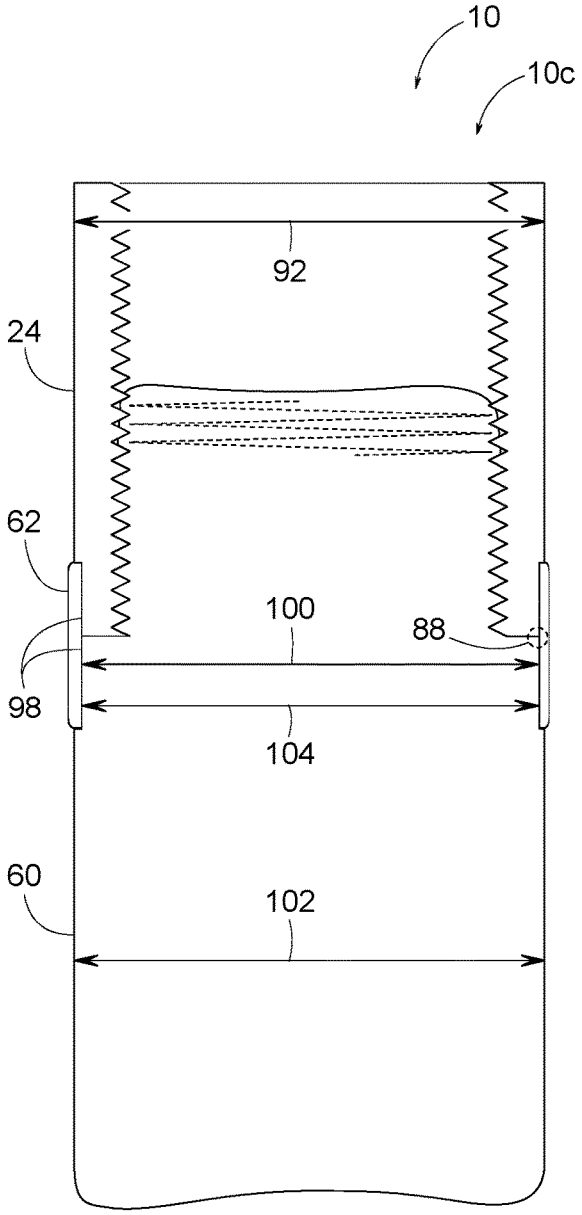
FIG. 7 is a cross-sectional view taken along line 7-7 of FIG. 6.

FIGS. 6 and 7 show the example bottom tubing cap 10*c*, which is similar to the examples shown in FIGS. 2-5; however, the bottom tubing cap 10*c* has a shallow groove 98 over which the covering 62 is applied. The shallow groove 98 provides a portion of the collar 24 and the protective plug 60 with a minor outer diameter 100 that is less than the collar's outer diameter 92 and less than an outermost diameter 102 of the protective plug 10*c*. In some examples, the collar's outer diameter 92 is approximately equal to the protective plug's outermost diameter 102.

The slightly smaller minor outer diameter 100 helps protect the three-way interface 88 from abrasion when the wellstring 20 is lowered into the casing 16. In some examples, the minor outer diameter 100 is 0.5 mm to 7 mm smaller than the collar's outer diameter 92 and 0.5 mm to 7 mm smaller than the outermost diameter 102 of the protective plug 60. In this example, the coating 62 has an inner diameter 104 that is the same as the minor outer diameter 100, so the coating's inner diameter 104 is also less than the collar's outer diameter 92.

Figure 8:
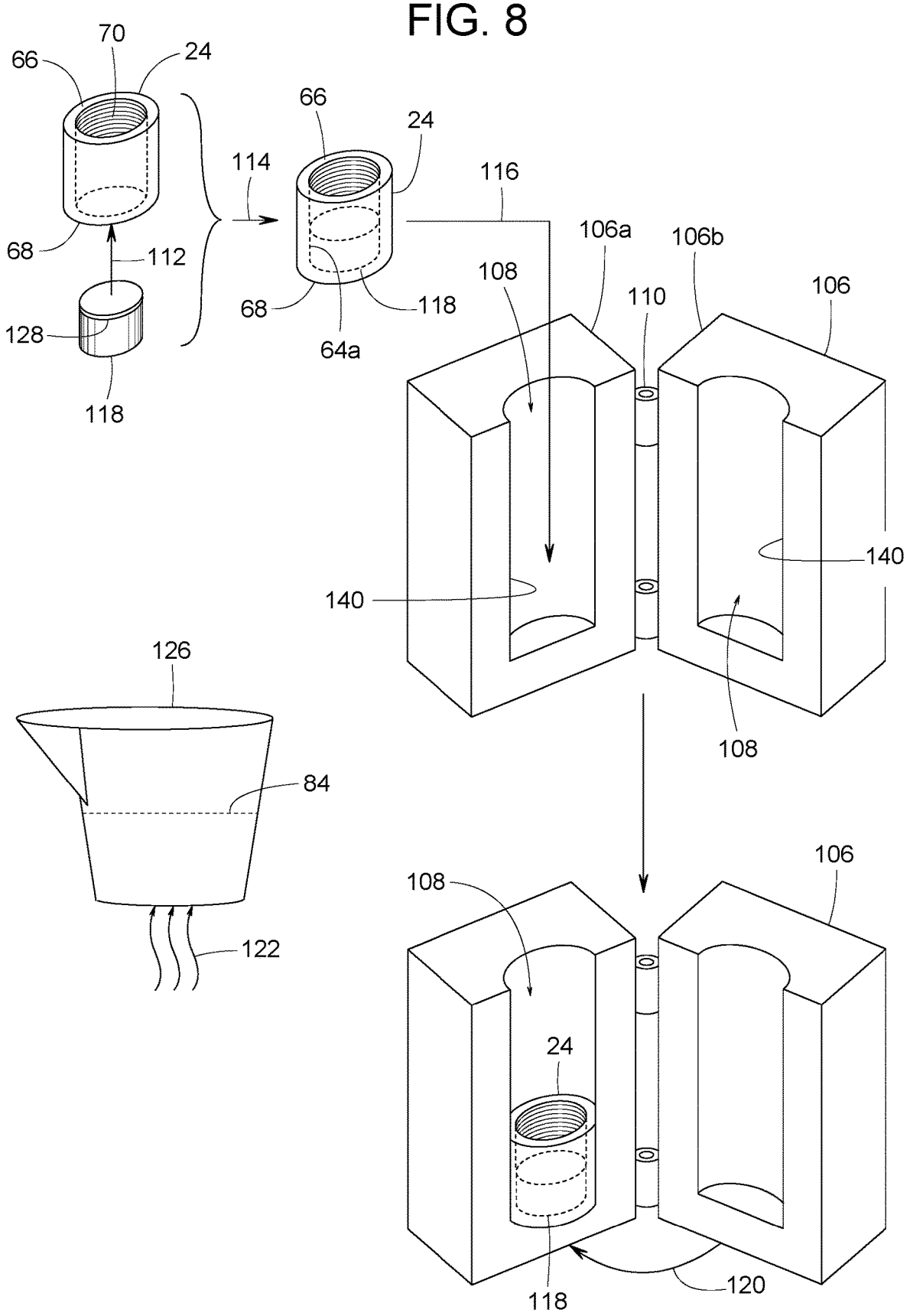
FIG. 8 is a schematic diagram illustrating various method steps for making an example bottom tubing cap.
Figure 9:
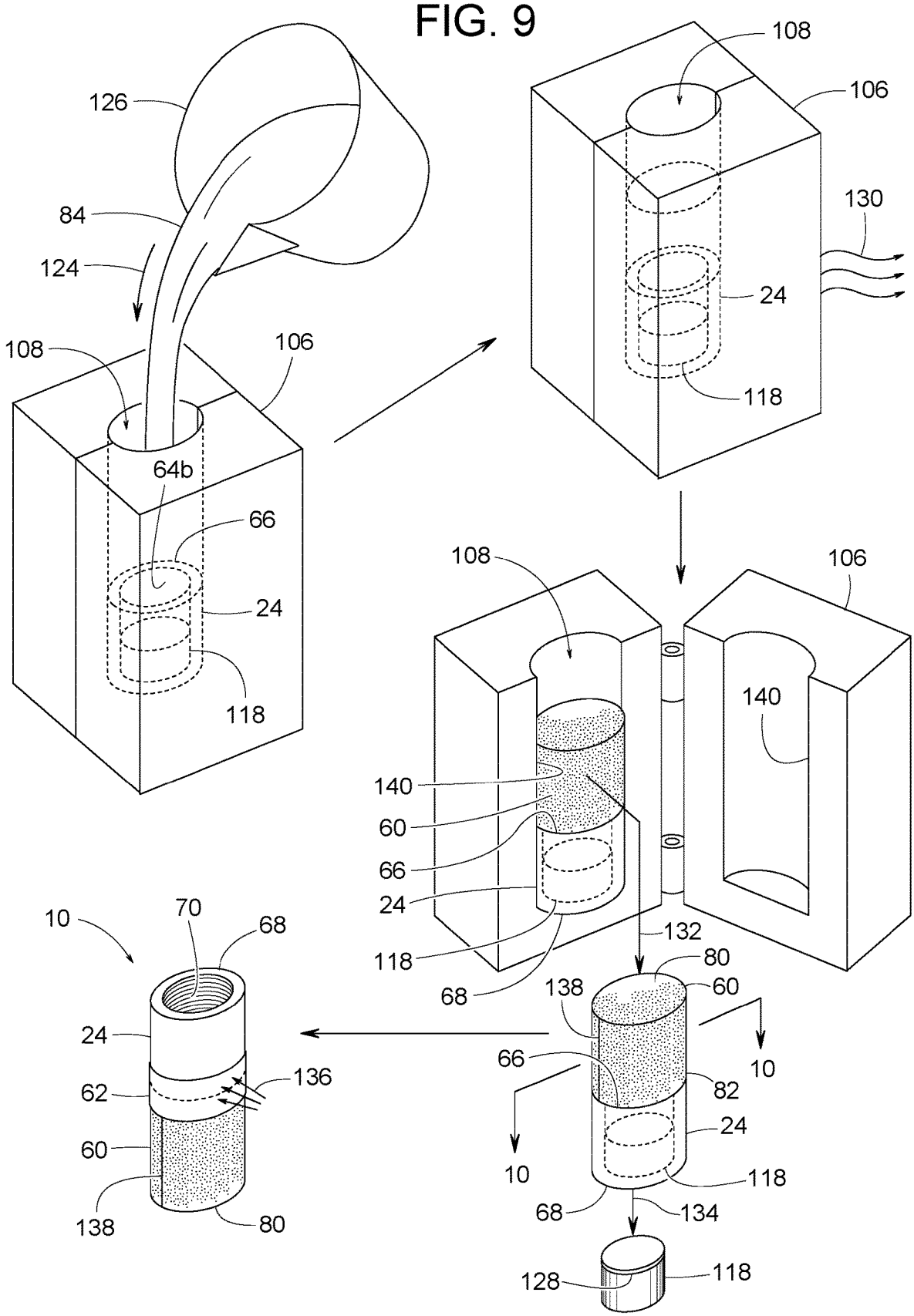
FIG. 9 is a schematic diagram illustrating additional method steps for making an example bottom tubing cap.

FIGS. 8 and 9 show an example method of using a mold 106 with a cavity 108 for making the bottom tubing cap 10. In this example, the mold 106 comprises a first mold part 106*a* and a second mold part 106*b*. In some examples, the first and second mold parts 106*a* and 106*b* are connected by a hinge 110 to create what is known as a book mold. In the illustrated example, the mold's two parts 106*a* and 106*b* can be brought in contact with each other to create a single cavity 108. In other examples, the mold 106 has multiple cavities for making multiple bottom tubing caps 10 in a single pour. Some examples of the mold 106 have eight cavities 108 for making eight bottom tubing caps 10 at a time.

In FIG. 8, arrows 112, 114 and 116 represent inserting a block-off member 118 into the collar 24 and into the cavity 108 such that the block-off member 118 extends into the upper section 64*a* of the collar 24 (the collar 24 is shown upside-down in the cavity 108). Arrow 120 represents closing the mold 106, i.e., moving the first mold part 106*a* in contact with the second mold part 106*b* to create the cavity 108 therebetween. Arrows 122 represent heating the second material 84 to a liquid state, wherein the second material 84 is a metal alloy selected from the group consisting of an aluminum alloy, a magnesium alloy, and a zinc alloy.

Referring further to FIG. 9, arrow 124 represents pouring the molten second material 84 from a crucible 126 into the mold's cavity 108 such that the second material 84 comes in intimate contact with the block-off member 118 and the internal threads 70 on the lower section 64*b* of the collar 24. The second material 84 (protective plug 60) has a lower melting temperature than the collar 24, so the molten second material 84 does not melt the collar 24.

The molten second material 84 coming in contact with the collar's internal threads 70 creates the helical gap 72 near the upper plug end 76. It takes longer for the molten second material 84 to cool near the lower collar edge 66, so the roots 74 of internal threads 70 in that area are more thoroughly filled with the second molten material 84.

The block-off 118 helps prevent the molten second material 84 from filling the collar's upper section 64*a*. Some examples of the block-off 118 include a heat resistant fabric pad 128 to enhance the block-off's ability to seal against the collar's internal threads 70. In some examples, the fabric pad 128 can be discarded after each use so the rest of the block-off 118 can be reused.

Arrows 130 of FIG. 9 represent cooling the second material 84 to a solid state to create the protective plug 60 that adheres to the collar 24, thereby creating the bottom tubing cap 10 comprising the collar 24 and the protective plug 60. In some examples, the mold 106 is air cooled by convection and/or water cooled via cooling passages through the mold 106.

Arrow 132 of FIG. 9 represents removing the bottom tubing cap 10 from the mold cavity 108. Arrow 134 represents separating the block-off member 118 from the bottom tubing cap 10. And arrows 136 represent applying the coating 62 on the protective plug's intermediate surface 82 such that the coating 62 covers at least some of the intermediate surface 82 of the plug 60 and covers at least some of the collar 24 adjacent to the intermediate surface 82.

In some examples, the casting method illustrated in FIGS. 8 and 9 creates a parting line, which is one example of a linear discontinuity 138 extending axially between the intermediate surface 82 and the lower plug end 80. The parting line coincides in location where edges 140 of the two mold parts 106*a* and 106*b* come together. In some examples, the actual shape of the linear discontinuity 138 can vary depending on the mold 106.

Figure 10:
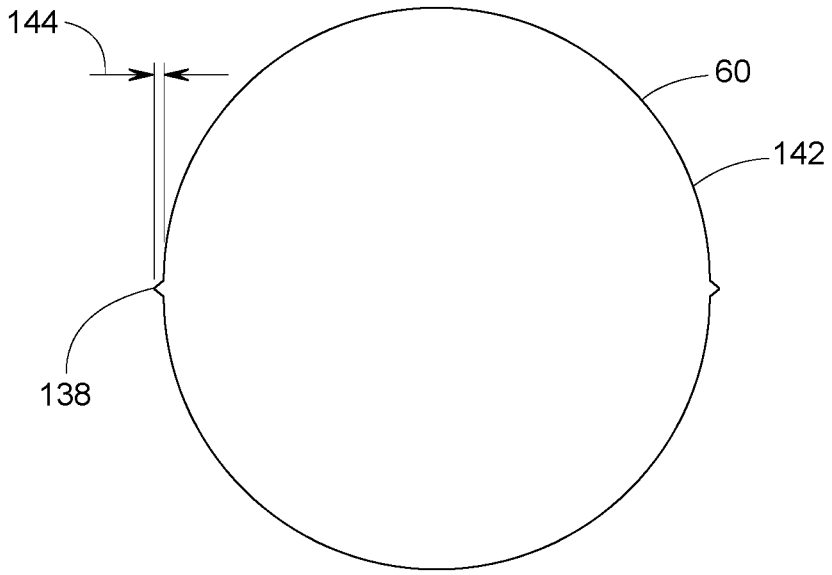
FIG. 10 is a cross-sectional view taken along line 10-10 of FIG. 9.
Figure 11:
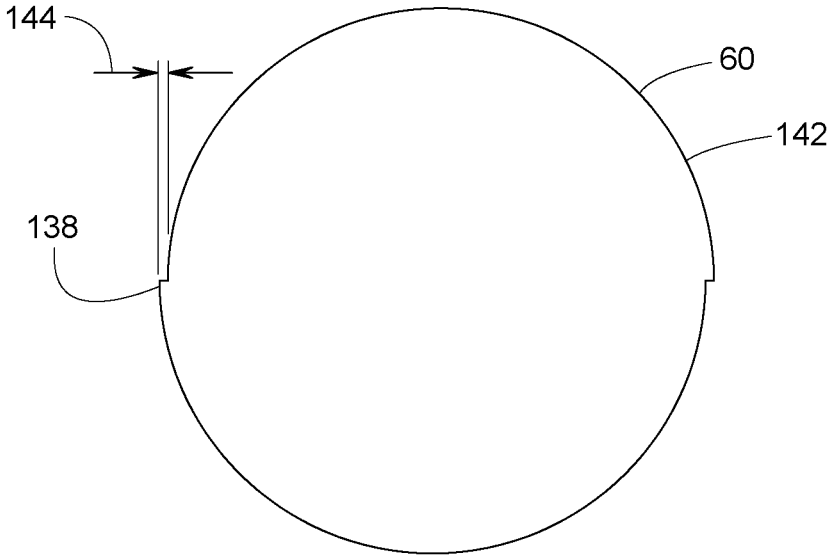
FIG. 11 is a cross-sectional view similar to FIG. 10 but showing another example of a protective plug.

FIG. 10 shows one example of the linear discontinuity 138. FIG. 11 shows another example of the linear discontinuity 138. FIGS. 10 and 11 are cross-sectional views showing examples of the bottom tubing cap 10, wherein their protective plugs 60 have an outer surface 142 with different examples of a linear discontinuity 138 extending axially between the intermediate surface 82 and the lower plug end 80.

The term, "linear discontinuity" as it relates to a surface means that the surface, regardless of how the surface was made, has at least a slight step or ridge running along a substantially straight line. The term, "substantially straight line" refers to a line that deviates less than one centimeter from a perfectly straight line. In some examples, the linear discontinuity 138 is identified as having a step dimension 144 of at least 0.025 mm.

As with the helical gap 72, the linear discontinuity 138 provides a telltale indicator that the protective plug 60 was melted and cast in place rather than machined and screwed in place. Thus, the existence of the linear discontinuity 138 indicates that the protective plug 60 is bonded intimately well to the collar 24 to ensure an effective galvanic coupling between the protective plug 60 and the collar 24.

Figure 12:
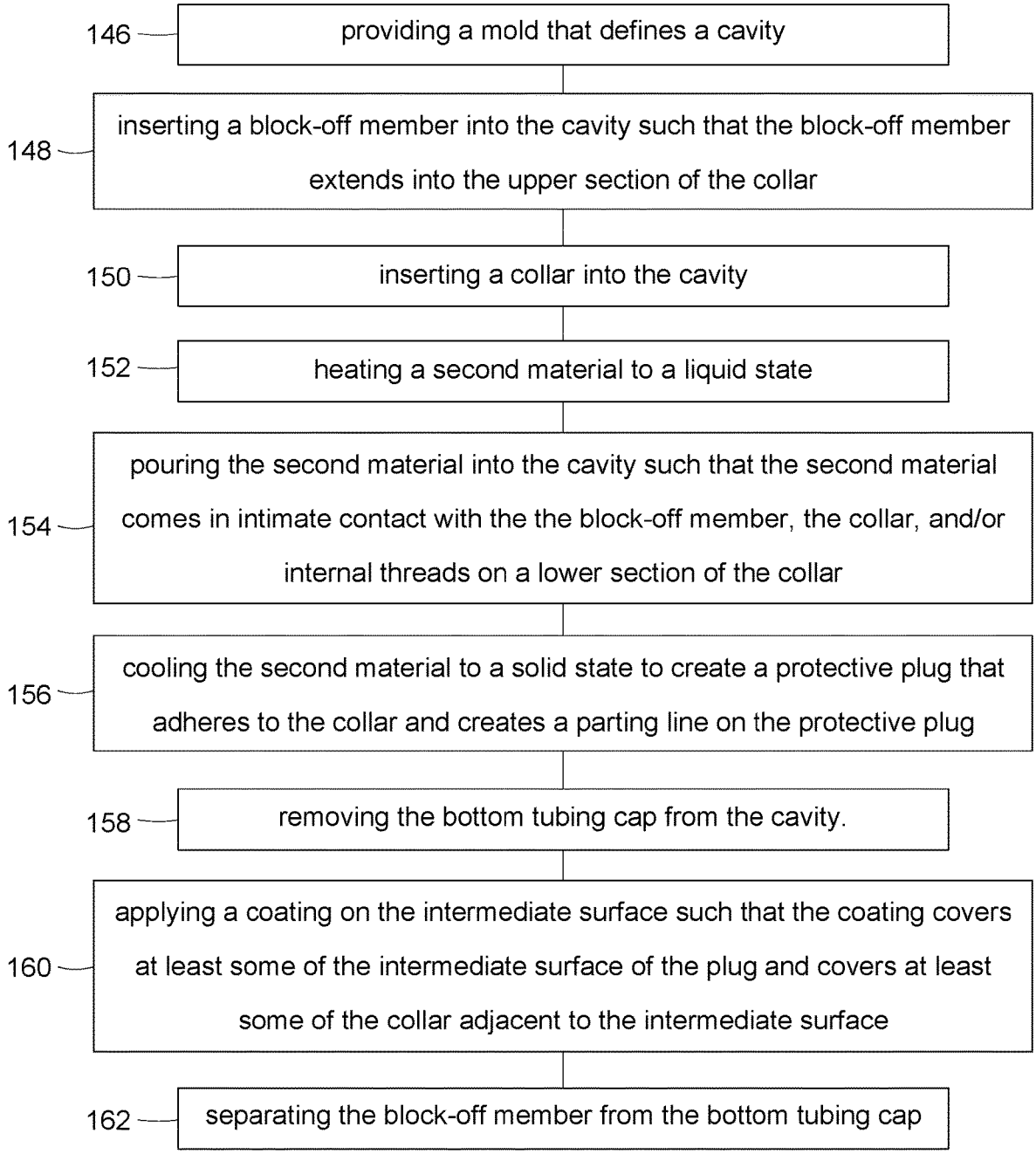
FIG. 12 is a flow diagram illustrating various method steps for making an example bottom tubing cap.

FIG. 12 show some examples method steps for making various examples of the bottom tubing cap 10. A block 146 represents providing the mold 106 that defines the cavity 108. A block 148 represents inserting the block-off member 118 into the cavity 108 such that the block-off member 118 extends into the upper section 64*a* of the collar 24. A block 150 represents inserting the collar 24 into the cavity 108, wherein the collar 24 has an inner surface 64 that includes an upper section 64*a* and a lower section 64*b*, the collar 24 has a lower collar edge 66 adjacent to the lower section 64*b*, the collar 24 has an upper collar edge 68 adjacent to the upper section 64*a*, the upper section 64*a* has internal threads 70 for screwing the collar 24 onto the wellstring 20, and the collar 24 is comprised of the first material. A block 152 represents heating the second material 84 to a liquid state, wherein the second material 84 is a metal alloy selected from the group consisting of an aluminum alloy, a magnesium alloy, and a zinc alloy. A block 154 represents pouring the second material 84 into the cavity 108 such that the second material 84 comes in intimate contact with the block-off member 118, the collar 24 and/or the internal threads 70 on the lower section 64*b* of the collar 24. A block 156 represents cooling the second material 84 to a solid state to create the protective plug 60 that adheres to the collar 24, thereby creating the bottom tubing cap 10 comprising the collar 24 and the protective plug 60, wherein the protective plug 60 has an upper plug end 76 axial interposed between the lower collar edge 66 and the upper collar edge 68, the protective plug 60 has a lower plug end 80 extending axially beyond the collar 24, the protective plug 80 having the intermediate surface 82 axially interposed between the lower plug end 80 and the upper plug end 76, and the intermediate surface 82 of the protective plug 60 is adjacent to the lower collar edge 66. A block 158 represents removing the bottom tubing cap 10 from the cavity 108. A block 160 represents applying the coating 62 on the intermediate surface 82 such that the coating 62 covers at least some of the intermediate surface 82 of the plug 60 and covers at least some of the collar 24 adjacent to the intermediate surface 82. A block 162 represents separating the block-off member 118 from the bottom tubing cap 10.

Some methods for making the bottom tubing cap 10 can be defined as described in the following examples 1-14.

Example-1 A method for making a bottom tubing cap for an oil well that includes a downhole pump connected to a wellstring, wherein the wellstring comprises a string of tubing and a string of sucker rods; the method comprising: providing a mold that defines a cavity; inserting a collar into the cavity, the collar having an inner surface that includes an upper section and a lower section, the collar having a lower collar edge adjacent to the lower section, the collar having an upper collar edge adjacent to the upper section, the upper section having internal threads for screwing the collar onto the wellstring, the collar being comprised of a first material; heating a second material to a liquid state, the second material being a metal alloy selected from the group consisting of an aluminum alloy, a magnesium alloy, and a zinc alloy; pouring the second material into the cavity such that the second material comes in intimate contact with the collar; cooling the second material to a solid state to create a protective plug that adheres to the collar, thereby creating the bottom tubing cap comprising the collar and the protective plug, the protective plug having an upper plug end axial interposed between the lower collar edge and the upper collar edge, the protective plug having a lower plug end extending axially beyond the collar, the protective plug having an intermediate surface axially interposed between the lower plug end and the upper plug end, the intermediate surface of the protective plug being adjacent to the lower collar edge; and removing the bottom tubing cap from the cavity.

Example-2 The method of Example-1, further comprising applying a coating on the intermediate surface such that the coating covers at least some of the intermediate surface of the plug and covers at least some of the collar adjacent to the intermediate surface.

Example-3 The method of Example-1, further comprising: inserting a block-off member into the cavity such that the block-off member extends into the upper section of the collar; pouring the second material into the cavity such that the second material comes in contact with the block-off member; and separating the block-off member from the bottom tubing cap.

Example-4 The method of Example-1, wherein the internal threads are also on the lower section, and the method further comprising: pouring the second material into the cavity such that the second material comes in intimate contact with the internal threads on the lower section; and creating a helical gap between the protective plug and the internal threads such that the helical gap is closer to the upper plug end than to the lower collar edge, and the helical gap is spaced apart from the lower collar edge.

Example-5 The method of Example-1, wherein the internal threads are also on the lower section, and the method further comprising pouring the second material into the cavity such that the second material comes in intimate contact with the internal threads on the lower section.

Example-6 The method of Example-1, further comprising applying a coating on the intermediate surface such that the coating covers at least some of the intermediate surface of the plug and covers at least some of the collar adjacent to the intermediate surface, and the coating comprises a polymeric material.

Example-7 The method of Example-1, further comprising applying a coating on the intermediate surface such that the coating covers at least some of the intermediate surface of the plug and covers at least some of the collar adjacent to the intermediate surface, and the coating is an epoxy.

Example-8 The method of Example-1, further comprising applying a coating on the intermediate surface such that the coating covers at least some of the intermediate surface of the plug and covers at least some of the collar adjacent to the intermediate surface; wherein the coating has an inner diameter, the collar has an outer diameter, and the outer diameter of the collar is greater than the inner diameter of the coating.

Example-9 The method of Example-1, wherein the mold comprises a first mold part and a second mold part, and the method further comprising: moving the first mold part in contact with the second mold part to create the cavity therebetween; and creating a parting line on the protective plug, wherein the parting line coincides in position where the first mold part comes in contact with the second mold part.

Example-10 The method of Example-1, wherein the protective plug is axially longer than the collar.

Example-11 The method of Example-1, wherein the protective plug is heavier than the collar.

Example-12 The method of Example-1, wherein the second material is an aluminum alloy falling within a US military specification defined by MIL-DTL-24779.

Example-13 The method of Example-1, wherein the second material comprises an aluminum alloy with a portion of indium, wherein the portion of indium makes up 0.014 to 0.200 percent by weight of the aluminum alloy.

Example-14 The method of Example-1, wherein the second material comprises an aluminum alloy with a portion of gallium, wherein the portion of gallium makes up 0.092 to 0.110 percent by weight of the aluminum alloy.

Example-15 The method of Example-1, wherein the collar is mostly steel and the protective plug is mostly aluminum.

It should be noted that a metal alloy is any a mixture of a metal and one or more additional materials. It should also be noted that the wellstring 20 comprises at least one or more of the following: the string of tubing 20*a*, the string of sucker rods 20*b*, the seating nipple 26, the downhole pump 18, the perforated sub 20, the gas anchor 40, the combination bull plug 50, and the collars 24 associated with the string of tubing 20*a*.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A bottom tubing cap for an oil well that includes a downhole pump connected to a wellstring, wherein the wellstring comprises a string of tubing and a string of sucker rods; the bottom tubing cap comprising:

a three-way interface attachable to the wellstring below the downhole pump, the three way interface comprising three adjoining materials including a first material, a second material and a third material; the first material comprising a steel, the second material comprising an aluminum and the third material comprising a polymer; each of the three adjoining materials being within two millimeters of each other.

2. The bottom tubing cap of claim 1, wherein the second material is an aluminum alloy comprised mostly of the aluminum by weight.

3. The bottom tubing cap of claim 2, wherein the second material comprises a portion of indium, wherein the portion of indium makes up 0.014 to 0.200 percent by weight of the aluminum alloy.

4. The bottom tubing cap of claim 2, wherein the second material comprises a portion of gallium, wherein the portion of gallium makes up 0.092 to 0.110 percent by weight of the aluminum alloy.

5. A bottom tubing cap for an oil well that includes a downhole pump connected to a wellstring, wherein the wellstring comprises a string of tubing and a string of sucker rods; the bottom tubing cap comprising:

a collar with an inner surface that includes an upper section and a lower section, the collar having a lower collar edge adjacent to the lower section, the collar having an upper collar edge adjacent to the upper section, the upper section having internal threads for screwing the collar onto the wellstring, the collar being comprised of a first material;

a protective plug engaged in intimate contact with the lower section, the protective plug having an upper plug end axial interposed between the lower collar edge and the upper collar edge, the protective plug having a lower plug end extending axially beyond the collar, the protective plug having an intermediate surface axially interposed between the lower plug end and the upper plug end, the intermediate surface of the protective plug being adjacent to the lower collar edge, the protective plug being comprised of a second material that is different than the first material, the second material being a metal alloy selected from the group consisting of an aluminum alloy, a magnesium alloy, and a zinc alloy; and a coating overlying the lower collar edge and the intermediate surface of the protective plug.

6. The bottom tubing cap of claim 5, wherein the internal threads are also on the lower section, and the protective plug is engaged in intimate contact with the internal threads on the lower section.

7. The bottom tubing cap of claim 5, wherein the internal threads are also on the lower section of the collar, the protective plug is engaged in intimate contact with the internal threads on the lower section, the protective plug and the internal threads on the lower section define a helical gap therebetween, the helical gap is closer to the upper plug end than to the lower collar edge, and the helical gap is spaced apart from the lower collar edge.

8. The bottom tubing cap of claim 5, wherein the coating comprises a polymeric material.

9. The bottom tubing cap of claim 5, wherein the coating is an epoxy.

10. The bottom tubing cap of claim 5, wherein the coating has an inner diameter, the collar has an outer diameter, and the outer diameter of the collar is greater than the inner diameter of the coating.

11. The bottom tubing cap of claim 5, wherein the protective plug has an outer surface with a linear discontinuity extending axially between the intermediate surface and the lower plug end.

12. The bottom tubing cap of claim 5, wherein the protective plug is axially longer than the collar.

13. The bottom tubing cap of claim 5, wherein the protective plug has a lower melting temperature than the collar.

14. The bottom tubing cap of claim 5, wherein the protective plug is heavier than the collar.

15. The bottom tubing cap of claim 5, wherein the second material comprises an aluminum alloy with a portion of indium, wherein the portion of indium makes up 0.014 to 0.200 percent by weight of the aluminum alloy.

16. The bottom tubing cap of claim 5, wherein the second material comprises an aluminum alloy with a portion of gallium, wherein the portion of gallium makes up 0.092 to 0.110 percent by weight of the aluminum alloy.

17. The bottom tubing cap of claim 5, wherein the collar is mostly steel and the protective plug is mostly aluminum.

18. The bottom tubing cap of claim 5, further comprising a bull plug coupling the collar to the downhole pump.

* * * * *